United States Patent [19]

Caillat et al.

[11] Patent Number: 4,776,608

[45] Date of Patent: Oct. 11, 1988

[54] SKI BINDING RELEASE THRESHOLD DISPLAY APPARATUS

[75] Inventors: Claude Caillat, Annecy; Jean-Pierre Dimier, Rumilly; Pierre Rullier, Annecy, all of France

[73] Assignee: Salomon S.A., Annecy, France

[21] Appl. No.: 889,842

[22] Filed: Jul. 28, 1986

Related U.S. Application Data

[63] Continuation of Ser. No. 559,218, Dec. 8, 1983, abandoned.

[30] Foreign Application Priority Data

Dec. 9, 1982 [FR] France ..... 82 20981

[51] Int. Cl.[4] ..... A63C 9/08

[52] U.S. Cl. ..... 280/634; 73/862.54

[58] Field of Search ..... 280/612, 634, 611; 73/161, 862.47, 862.64, 862.54

[56] References Cited

U.S. PATENT DOCUMENTS

| | | | |
|---|---|---|---|
| 2,940,308 | 6/1960 | Calhoun | 73/862.64 |
| 3,210,994 | 10/1965 | Saxl | 73/862.47 |
| 3,282,083 | 11/1966 | Sonderegger | 73/161 |
| 3,952,587 | 4/1976 | Goodhart | 73/862.54 |
| 4,405,152 | 9/1983 | Nitshko | 280/634 |
| 4,431,210 | 2/1984 | Nitshko | 280/634 |
| 4,468,049 | 8/1984 | Le Faou et al. | 280/634 |

FOREIGN PATENT DOCUMENTS

| | | |
|---|---|---|
| 2201107 | 4/1974 | France . |
| 2215983 | 8/1974 | France . |
| 2228509 | 12/1974 | France . |
| 2328956 | 6/1977 | France . |
| 2449458 | 9/1980 | France . |

*Primary Examiner*—John J. Love
*Assistant Examiner*—Michael Mar
*Attorney, Agent, or Firm*—Sandler & Greenblum

[57] ABSTRACT

A display apparatus and method for displaying the value of the release threshold to which a ski binding is adjusted. The display apparatus is an electronic display means for electronically displaying the release threshold of the binding.

40 Claims, 9 Drawing Sheets

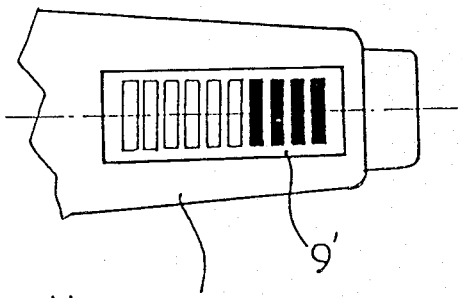
Fig. 11
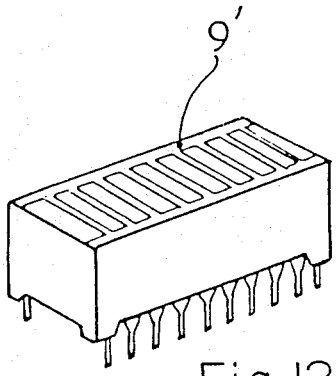
Fig. 12
Fig. 13
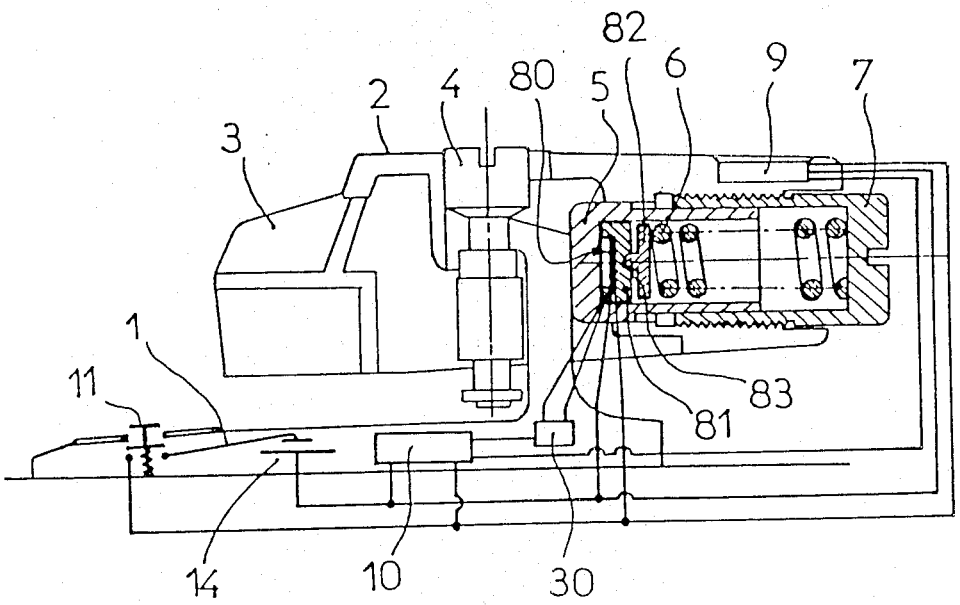

SKI BINDING RELEASE THRESHOLD DISPLAY APPARATUS

This is a continuation of application Ser. No. 559,218 filed Dec. 8, 1983 adandoned.

BACKGROUND OF THE INVENTION

1. Field of the Invention

The present invention relates to a display apparatus which displays the adjustment setting of a ski binding. More particularly, the invention is directed to a numeric display apparatus which displays the threshold force which results in ejection of the boot from the binding.

2. Material Disclosure Statement and Description of Background

In what is now conventional, ski bindings comprise at least one elastic element which biases an abutment jaw located in front of the boot or in the rear against the heel into a central position for the positive maintenance of the boot. The jaw or maintenance element is adapted to pivot with respect to a support connected to the ski in a manner so as to free the boot when it exerts a force on the jaw which exceeds a given value known as the "release threshold".

It is essential for the safety of the skier that the force exerted permanently by the elastic element on the jaw can be adjusted to a predetermined value at release, which corresponds to the release threshold. The actual setting is a function of various parameters, particularly of the skill and weight of the skier, as well as the type of trail or course being skied, and snow conditions. Also, some apparatus allow for a "harder" or "softer" adjustment, depending upon how aggressively the course is being skied.

Additionally, once this adjustment has been set, it is important that the skier be able at any time to ascertain that his original adjustment has not been modified to a substantial extent by, for example, forces to which the elastic element may be subjected, or as a result of an adjustment made by another skier.

Thus, a number of bindings exist which include an indicator for indicating the absolute force adjustment which in turn can be correlated to the release threshold. The elastic system which applies a force on the jaw comprises a movable element biased by a spring which is itself compressed to varying degrees by the position of the adjustment element which is accessible to the user. The indication of the position of the adjustment element is nothing more than an indication of the position of the adjustment element with respect to a fixed element, for example the relative position of a reference point on a screw with respect to a fixed nut, or of the position of the movable element with respect to another reference element. To allow for as rapid a reading as possible, these relative positions are translated by the position of a pointer with respect to a graduated scale or by an equivalent means. Such apparatus are described in French patent application Nos. 2,201,107; 2,215,983; 2,228,509; 2,328,956; and 2,449,458, the disclosures of which are hereby incorporated by reference thereto.

Whatever attempts have been made in any of the known apparatus to increase the facility or the precision with which the adjustment can be read by the user, the adequacy of these measures is clearly limited by virtue of the dimensions which must necessarily remain as small as possible, and the ubiquitous difficulty of appreciating accidental changes at a single glance, or changes due to use that the adjustment value may have undergone since the last intentional adjustment of the device. As a result, skiers have come to rely more on their own intuition, together with the potential risks which this implies, rather than effectively verifying the position of the adjustment, due to the imprecision and the difficulty of reading the adjustment which this would entail.

SUMMARY OF THE INVENTION

It is, therefore, an object of the invention to provide a display apparatus for displaying the value of the release threshold to which a ski binding is adjusted. The binding has a retention element for retaining a ski boot on a ski. The retention element is adapted to pivot with respect to a support connected to the ski to free the boot, and is returned to the centered position by an elastic mechanism which exerts a force whose value may be adjusted so as to define the release threshold. The binding further includes at least one movable element biased by a spring, and an adjustment element for adjusting the tension of the spring and the force which it exerts on said movable element. The display apparatus is an electronic display means for electronically displaying the release threshold of the binding.

More particularly, and in one embodiment, the invention is directed to a ski binding apparatus which includes the above display apparatus.

The apparatus may further include a transducer for transforming the spring tension into electronic information, and an electronic circuit for driving, controlling and processing the electronic information.

The electronic display means may include a module for electronically displaying the release threshold value. The module may have a numeric display or an an incremented display.

The transducer and module may be associated with the body of the binding wherein the electronic circuit is contained in a separate container which may remain physically separate from the binding and be adapted to be electrically connected as required to the transducer and to the module. The module may be positioned in the container or mounted on the binding.

Alternatively, the transducer, the module, and the electronic circuit may all physically be mounted on the body of the binding, and be adapted to remain associated therewith during use.

The transducer may be a potentiometer measuring the displacement of the adjustment element, for example, relative to a reference point on the body of the binding.

The potentiometer may comprise a wiper adapted to move along a winding and be operatively associated with the adjustment element whereby movement of the adjustment element moves the wiper along the winding. The winding may be fixedly secured to the interior of said body.

The adjustment element may, in one embodiment, comprise an adjustment cap extending to the exterior of the body.

In this embodiment the adjustment element is rotatable and is adapted to move in axial translation. It comprises an annular groove adapted to receive the wiper therein whereby axial translation of the adjustment element moves the wiper along the winding. The winding itself comprises a strip mounted within the binding body such that the wiper makes electrical contact with the strip.

According to another embodiment the adjustment element is translationally fixed but is free to rotate. In this case the spring is tensioned against a nut threadably mounted on the adjustment element whereby rotation of the adjustment element results in axial movement of the nut. The wiper is mounted to move with the nut along the winding.

Alternatively, the wiper may be a ring secured onto the adjustment screw such that the wiper makes electrical contact with the winding during rotation and axial movement of the adjustment element. The ring may be movable relative to said adjustment crew to allow for calibration of said apparatus.

Instead of a potentiometer a strain gauge may be used as a transducer. A sensor such as a a wheatstone bridge positioned on a test body biased by the spring may be used. The test body may be positioned between the movable element and an intermediate element biased by the spring.

A stabilization circuit may be provided for stabilizing the feed of the stress sensor and amplifying the output signal of the stress sensor.

Generally, the electronic circuit may comprise a battery, at least one switch, an amplifier, an analog-numeric numeric converter, and a decoding and piloting circuit to drive the module. The electronic circuit may further comprise a timer controlling a timing switch adapted to de-energize the circuit, whereby the display is de-energized after a pre-set time period. A manual switch is mounted in parallel across the timing switch to allow for override of the timing switch.

Rather than being considered as a part of the binding, the invention also includes a display apparatus alone which displays the value of the release threshold to which a ski binding is adjusted. The display apparatus comprises an electronic display means for electronically displaying the release threshold of the binding. The electronic display means is physically separate from the ski binding and is electrically connectable thereto.

Viewed differently, the invention is also directed to a method of displaying the value of the release threshold to which a ski binding is adjusted which comprises electronically displaying the release threshold of the binding.

BRIEF DESCRIPTION OF THE DRAWINGS

The invention will now be described with reference to the annexed embodiments given by way of non-limiting example only, in which:

FIGS. 11 and 12 illustrate another type of display module for displaying the adjustment value;

FIGS. 13–15 illustrate an embodiment in which the effect of spring pressure is detected by a force sensor rather than a transducer;

FIG. 13 is a Figure corresponding to that of FIG. 1;

FIG. 14 is a Figure similar to that of FIG. 3; and

FIG. 15 is a Figure similar to that of FIG. 10.

DESCRIPTION OF PREFERRED EMBODIMENTS

It is an object of the invention to overcome the disadvantageous situations described above by providing the skier with information which is both precise and easily readable. This objective is achieved by displaying the adjustment force directly in numerical format, or in the form of luminous signals, by utilizing a transducer which transforms the release threshold value into electronic data, which, when converted, is displayed on a conventional electronic display module, for example of the numeric type, or of the incremental type wherein the numerals are formed of discrete points or segments.

FIGS. 1–10 illustrate a first embodiment in which the position of the adjustment cap is detected, and the resulting information is transformed into a release value.

Figure 1:
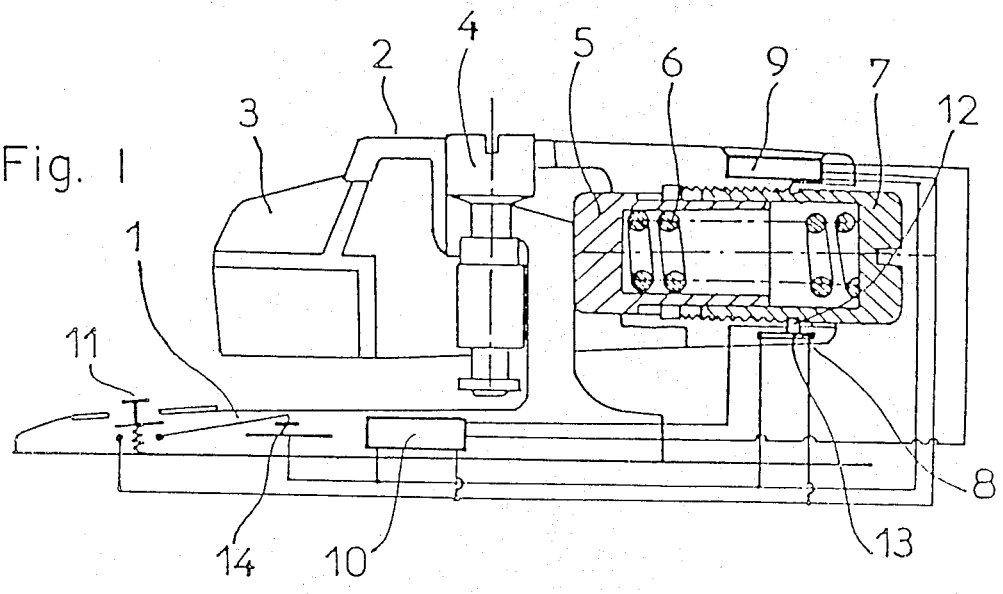
FIG. 1 illustrates a conventional binding which may be used according to the invention in longitudinal cross-section.
Figure 2:
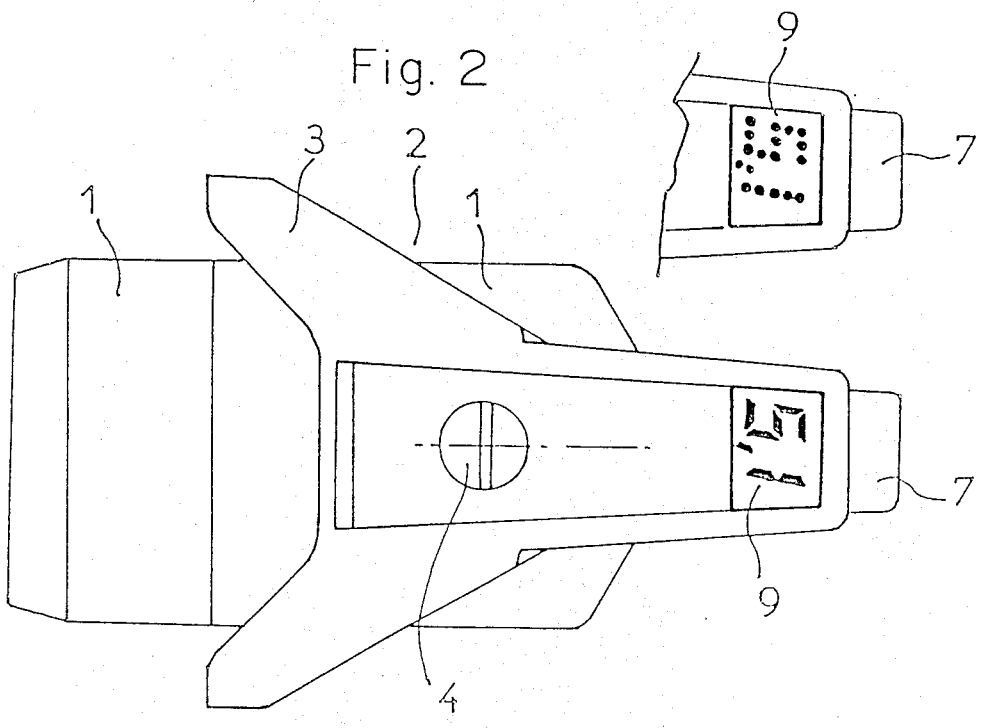
FIG. 2 illustrates a top view of the binding of FIG. 1.

FIGS. 1 and 2 schematically illustrate an adjustment mechanism for adjusting the release threshold of a safety binding with which the invention may be used. FIG. 1 illustrates the invention in connection with a front abutment binding. It is however to be understood that the system could just as well be used in conjunction with a heel binding, or a binding which is part of the boot itself.

Likewise, the adjustment apparatus for adjusting the release threshold can be of any type. According to one embodiment the adjustment apparatus may comprise at least one movable element, an elastic element biasing the movable element and an adjustment cap which is accessible from the exterior so as to allow for the desired adjustment of the tension of the elastic element.

As may be seen from FIG. 1, a typical binding 2 may comprise a jaw 3 for holding down a boot (not shown) on base plate 1, attached to the ski (not shown). In a known manner, under torsional pressure, binding 2 pivots around a vertical axis pin 4 fixedly mounted with respect to plate 1 to free the boot. The jaw is returned, likewise in a known manner, to a centered latching position by an adjustable elastic tensioning apparatus. The elastic tensioning apparatus comprises movable element 5 which is movable with respect to binding body 2 and which is biased by a compression spring 6. The tension of spring 6 is adjusted by rotation of the adjustment element shown as cap 7 which is accessible from the exterior of the binding casing. Preferably, and in a conventional manner, adjustment cap 7 acts as a screw which cooperates with interior threads which form a nut in binding 2. Thus, the magnitude of the force exerted by spring 6 on movable element 5 is determined by the degree to which cap 7 is tightened. Also, the magnitude of the force necessary to pivot binding 2 around vertical axis pin 4 also corresponds to the degree to which cap 7 has been tightened.

According to the invention, the magnitude of the release threshold force is detected by transducer 8. The transducer transforms this value into electronic data which is then displayed in a numeric format in a conventional electronic display module 9 positioned, for example, in the upper portion of the body of binding 2 so as to be perfectly visible by the skier. Electronic circuit 10 which is preferably positioned in base plate 1 assures the energization and control of the components and processing of the information, particularly its conversion into a numeric format for display 9. Switch 11 which can be either manual and/or automatic, and may for example be boot activated, allows for switching the apparatus on and off. The electronic wiring between various components 8, 9, 10 and 11 pose no particular problem and can pass through the body of binding 2 and base plate 1. If they are metallic, the body and base plate can themselves constitute one of the necessary conductors. Display module 9 can, in a known manner, be of the liquid crystal type (FIG. 2) or be an electroluminescent diode (partial view of FIG. 2). The latter solution assures better visibility of the displayed information. Preferably, this information will directly provide the detected value of the adjustment force, or even preferably, display the torsional moment corresponding to the lateral release threshold value. Such a value is shown in FIG. 2 as 5.1 (m.daN or m.kgf). The adjustment thresholds normally utilized vary between several m.daN and 20 m.daN for a front abutment and 80 m.daN for a rear binding. The double digit display allows for a precision which, although significant and desirable, could never be obtained with a conventional display of the type described in the materials previously discussed.

As may be seen from FIG. 1, transducer 8 acts as a potentiometer. The tension of spring 6 depends directly on the displacement of adjustment element or cap 7 with respect to the body of binding 2. To detect and transform this displacement into electronic data, cap 7 axially translates wiper 12 which cooperates with a potentiometric winding 13 within binding body 2.

Figure 3:
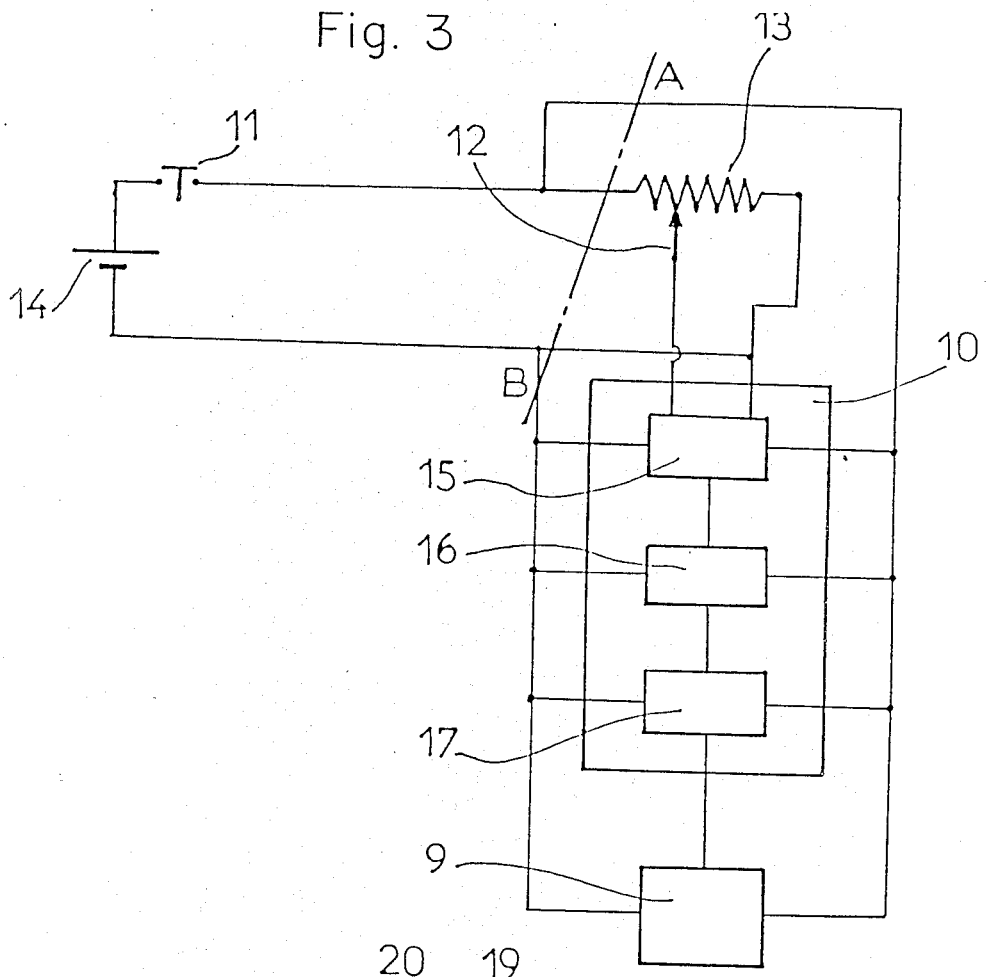
FIGS. 3 and 3*a* are electronic schematic diagrams of circuits for use in a device according to the invention.

FIG. 3 is a schematic diagram which functionally illustrates the operation of the various circuit components. Battery 14 which may be disconnected by switch 11 energizes potentiometer 12, 13; processing and control circuit 10; and display module 9. The output of potentiometer 12, 13 passes into circuit 10 which comprises amplifier 15 and an analog/numeric converter 16. The output of converter 16 is sent to a decoding pilot circuit 17 which controls the display of the numeric data on display module 9.

Figure 3A:
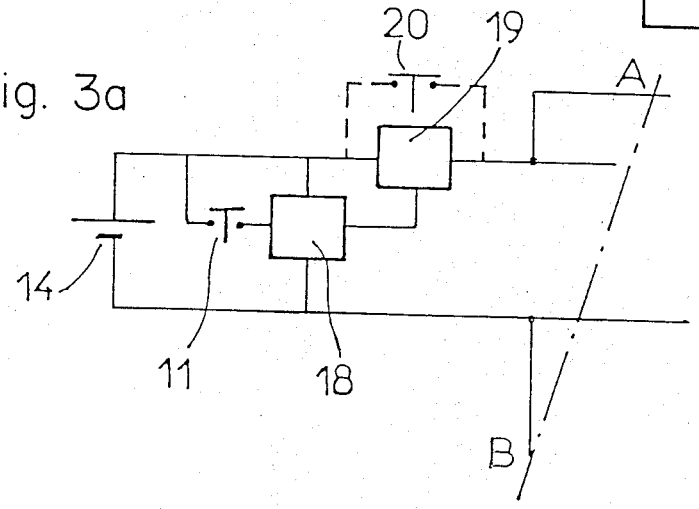

FIG. 3*a* illustrates an alternative assembly of energization circuit 14, and switch 11 to the left of line AB of FIG. 3. In addition to battery 14 and conventional switch 11, this circuit comprises a timing circuit 18 which controls an electronic switch 19 such as a one shot multivibrator. This arrangement allows for the cutoff of the circuit by electronic switch 19 at the end of a pre-set delay, for example several seconds, so as to conserve the energy of battery 14. Interrupter 11 is activated, for example, by pressure exerted by the boot of the skier. To trigger a new display without having to remove and re-insert the boot, a manual switch 20 (shown in dashed lines) can be mounted in parallel with electronic switch 19. This provision allows for activation of the display circuit at will.

The specific circuits utilized will now be described in greater detail below.

Figure 4:
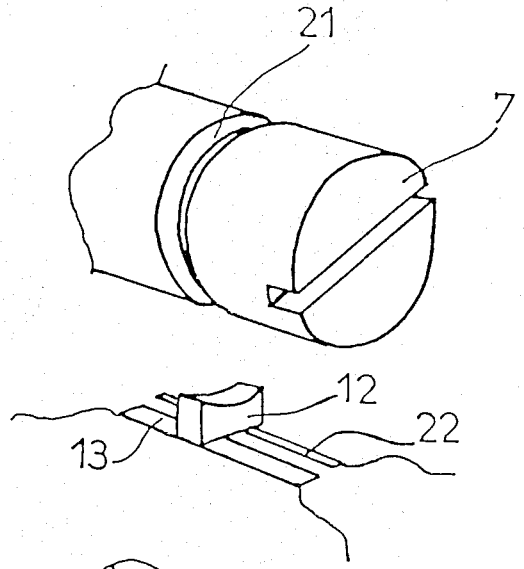
FIGS. 4 and 4*a* illustrate one embodiment of a potentiometer usable within the scope of the invention.
Figure 4A:
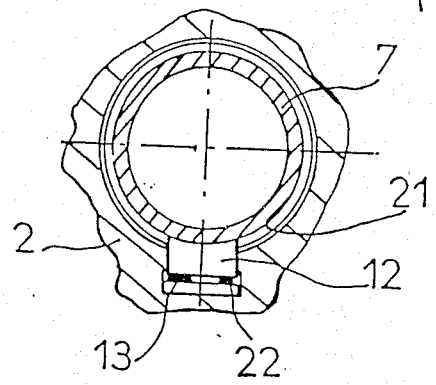

FIGS. 4 and 4*a* illustrate one embodiment of potentiometric transducer 8 which can be utilized according to the invention, FIG. 4*a* being a transverse cross-sectional representation. Conventional adjustment cap 7 can be screwed to varying degrees in binding body 2 to compress spring 6 (FIG. 1). Cap 7 may comprise an annular groove 21 with which a wiper 12 adapted to be displaced axially in a groove provided within binding 2 cooperates at its lower position. Wiper 12 is in electronic contact with a first feed conductor 22 and with a potentiometric winding 13, which may for example be made of ceramic metal (cermet) and whose length, and thus whose resistance, in circuit, varies as a function of the displacement and position of cursor 12.

Figure 5:
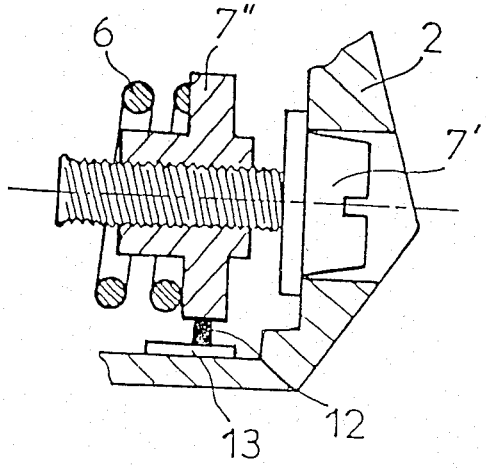
FIG. 5 is an alternative embodiment of the adjustment element for exerting the release force of the binding.

In the embodiment of FIG. 5, adjustment element 7 is in the form of a rotatable screw 7' which is translationally fixed, and extends through nut 7''. Nut 7'' is not free to rotate but instead translates axially within the body of binding 2. Nut 7'' acts directly against spring 6. Wiper 12' is integral with nut 7'' and thus translates longitudinally in contact with potentiometric winding 13'.

In the embodiment of FIG. 9 adjustment cap 7 is again shown, but this time carrying a circular ring which is wiper 12'' itself, in contact with a fixed potentiometric winding. This ring which is mounted to slide hard up against the conductor and winding 13 has the advantage of being able to be movable relative to cap 7 which carries it to allow for the calibration of the apparatus.

It is clear that other equivalent embodiments can be utilized. For example, a fixed wiper 12 carried by binding body 2, in contact with a potentiometric winding 13 carried by adjustment element 7, which is itself translationally movable, could be used. In such an embodiment winding 13 would have a greater axial extent than that shown in FIG. 5 such that its movement over the fixed wiper results in a changing resistance as the adjustment cap is rotated.

Figure 6:
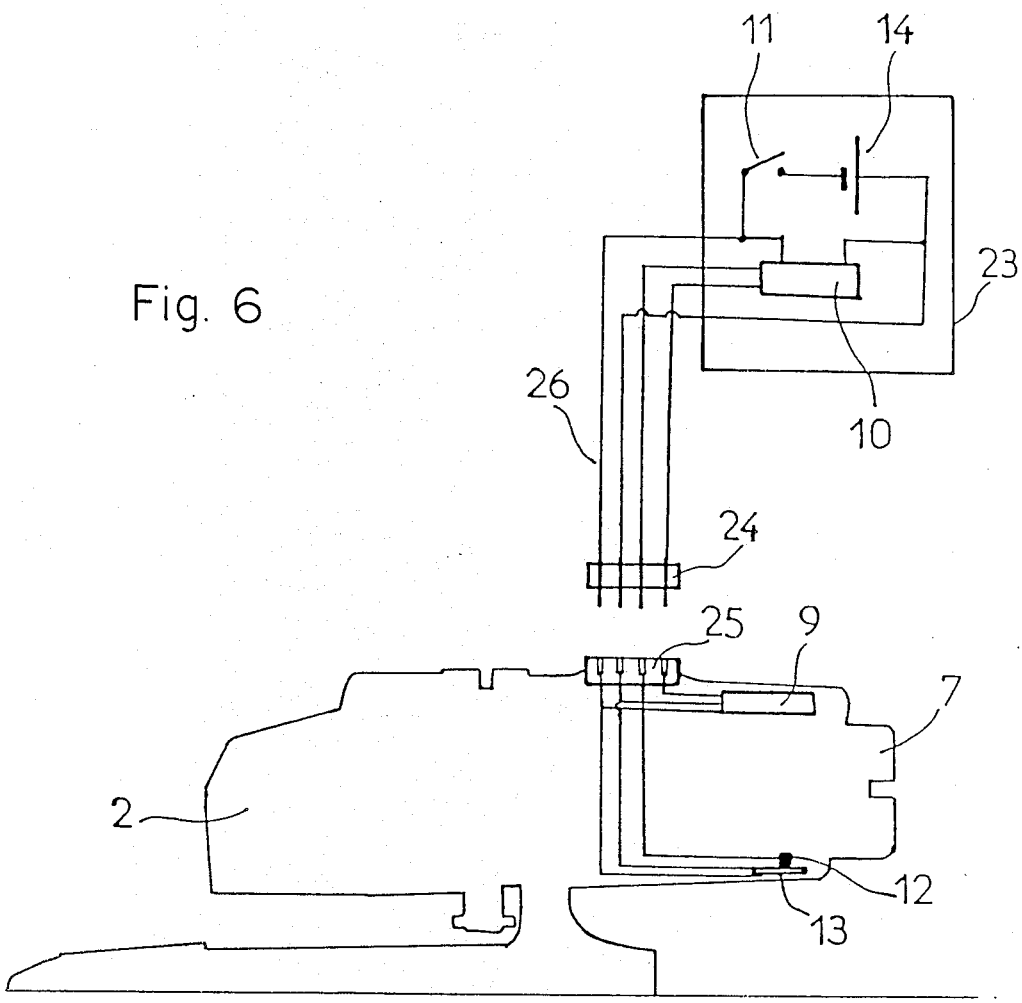
FIG. 6 illustrates an embodiment of the invention in which the assembly for powering the circuit, processing the information and providing the control necessary for detection and display is in the form of a discrete unit separate from the binding.

FIG. 6 illustrates a preferred circuit arrangement of the various elements of an apparatus according to the invention. In this case, only the potentiometer, comprising wiper 12 and winding 13 according, for example, to an embodiment described above, and the numeric display module 9 are integrated with the binding 2 itself. All other elements are external and independent of the binding. They may, for example, assume the compact form of a single box 23 containing (or carrying) battery 14, switch 11, and circuit 10 for processing of data and piloting of display 9. Box 23 has a cable 26 containing electric wiring which ends in a connector 24 which is preferably male and which can be plugged into a female plug 25 carried by binding 2. All the elements of the apparatus can in all, or in part, have the characteristics described above.

This arrangement is particularly advantageous because it protects elements which need not be needlessly subjected to the difficult conditions often involved in skiing, such as cold, humidity, shocks, etc. to such condition. These elements form an external control assemly for monitoring the adjustment of the binding encased in a single container 23.

Using this approach, the control assembly is excluded from the cost of binding 2, and can constitute a standard device collectively usable for all bindings of this type. Control container 23 could then be positioned and made accessible to the user, for example in the skier's home, or in his pocket, in shops, in customer service establishments at ski stations, cafes, at mechanical ski lift structures, etc. It should also be noted that the display module could be positioned in the control container instead of being associated with the binding itself.

Figure 7:
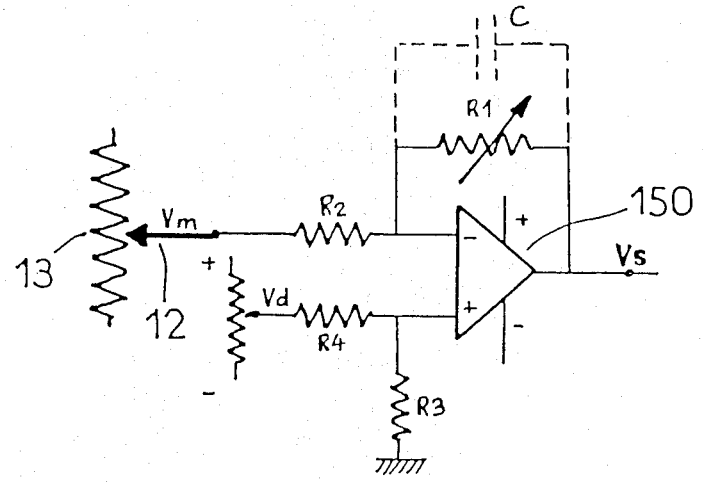
FIGS. 7 and 8 are two schematics of electronic circuits subsequent to the transducer.
Figure 8:
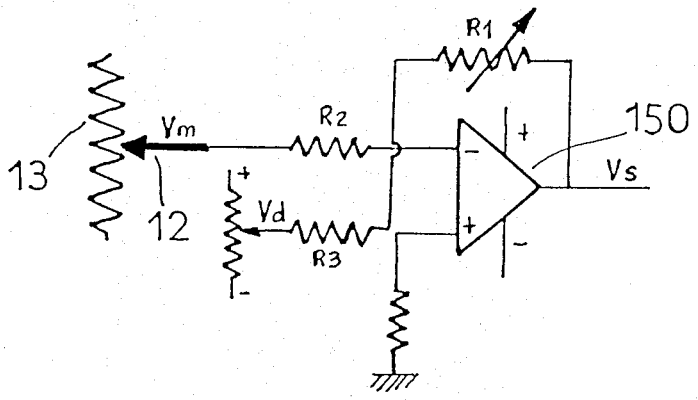
Figure 9:
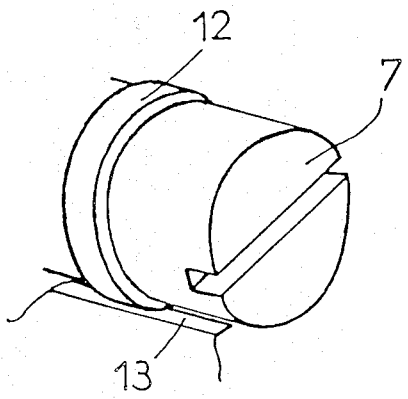
FIG. 9 is an alternative embodiment of the adjustment cap for adjusting the release force of the binding.

FIGS. 7 and 8 illustrate two possible electronic assemblies of potentiometer 12, 13 and amplifier 150 (FIG. 3). Vm is the voltage on. The voltage Vs at the output of operational amplifier 150 is a function of Vm, the reference voltge Vd, and the resistances R1–R3 (FIG. 8) or R1–R4 in FIG. 7 according to the relationship:

$$Vs = -\left(\frac{R1}{R2}\right)Vm + \left(\frac{R3}{R4}\right)Vd$$

or $$Vs = -\left(\frac{R1}{R2}Vm + \frac{R1}{R3}Vd\right)$$

Variable resistance R1 mounted in parallel across the inverter input of operational amplifier 150 and its output serves to regulate its gain, which allows for the calibration of the force measurement on the display. The approach of FIG. 7 appears to be most advantageous for performing this, because it allows for independently adjusting the gain with respect to zero, with the zero adjustment being able likewise to serve for calibration. Preferably, a capacitance C is mounted in parallel with adjustable resistance R1 in a manner so as to limit the pass band.

Figure 10:
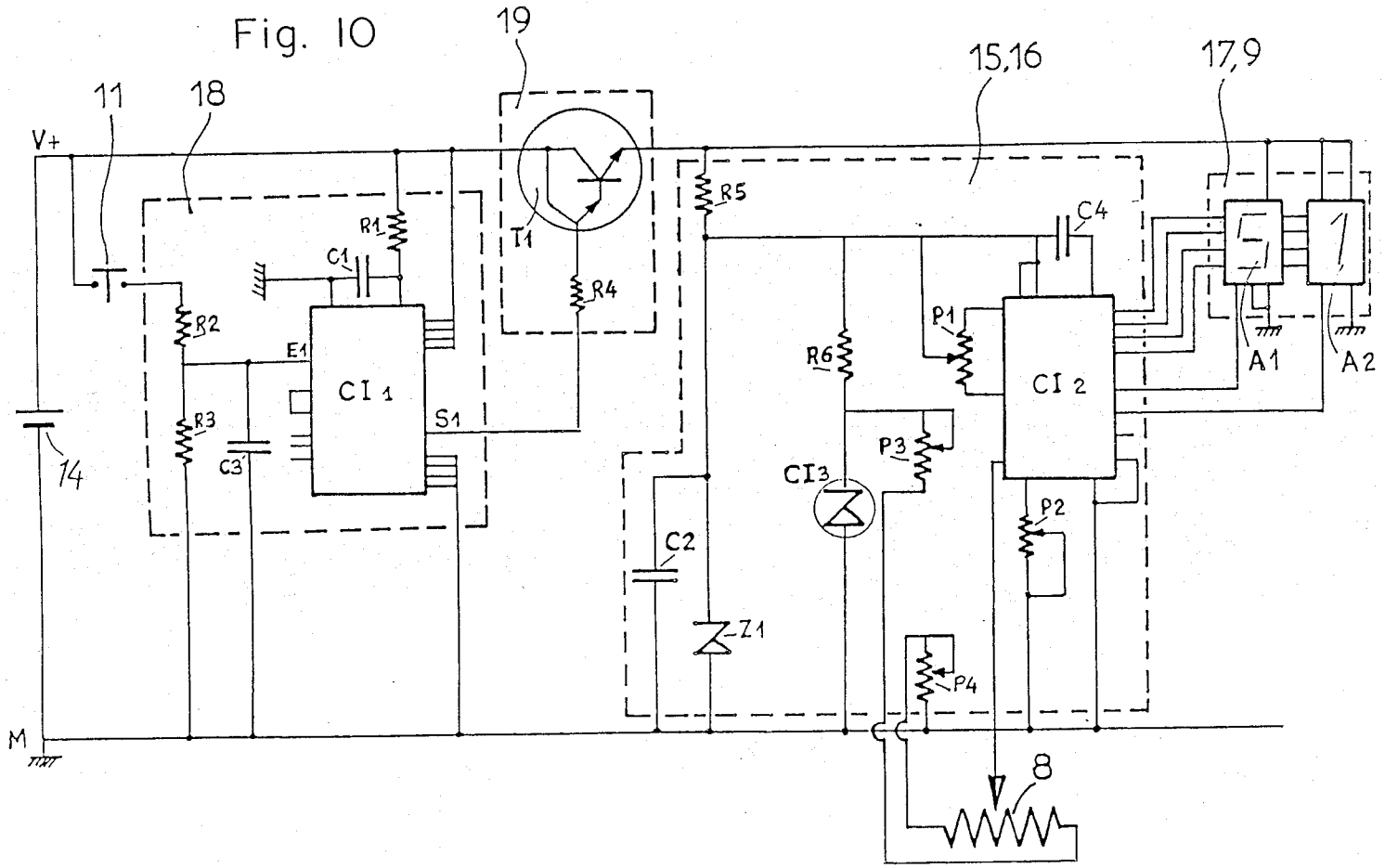
FIG. 10 is a schematic diagram illustrating one possible embodiment of the electronic portion of the device according to the invention.

An example of the embodiment of the electronic circuit assembly 10 for detection, processing and control of the display of information, is shown in FIG. 10. It shows, inter alia, external battery 14, switch 11 and potentiometric transducer 8, timing sub-assemblies 18, electronic switch 19, amplifier-converter 15, 16 and display pilot 17, 9 corresponding to those of FIGS. 3 and 3*a*.

Timer 18 comprises resistances R1, R2, and R3, capacitance C1 and C3, and a flip-flop integrated monostable circuit $CI_1$ (for example Motorola circuit MC14538B). This circuit operates as follows:

As long as switch 11 is open, input $E_1$ and output $S_1$ of $CI_1$ is at a voltage close to that of ground. When 11 is closed, the voltage at $E_1$ goes up to a value such that the output $S_1$ reaches a voltage close to that of bus V+. The assembly of elements $R_2$, $R_3$, $C_3$ allows for a limitation of the velocity of the rise and fall times of the input $E_1$, thus limiting the parasitic impulses due to contact-bounce of switch 11. $R_3$ furthermore allows, when switch 11 is open, for voltage $E_1$ to be held at a value close to that of ground which thus avoids ambiguity as to the output value $S_1$. Elements $R_1$ and $C_1$ fix time T during which $S_1$ remains at a limited value. When time T runs out, $S_1$ once again becomes low. The monostable circuit $CI_1$ is wired such that for $S_1$ to produce another pulse, switch 11 first must be opened for a time sufficient to allow $C_3$ to discharge through $R_3$ such that $E_1$ once again becomes low, then is closed again.

Electric switch 19 comprises resistance $R_4$ and a commutator $T_1$ of the Darlington type. The switch serves to drive the rest of the circuit only during the time T where $S_1$ is elevated. $R_4$ serves to match the impedance between output $S_1$ of $CI_1$ and input $T_1$. The timer and the electronic switch ensure that except when the voltage on $S_1$ is high, the energy consumed is limited to that consumed by $CI_1$ and its peripheral circuit, as well as by the leakage currents of $T_1$, i.e. several hundredths of microamperes. The life of battery 14 is thus prolonged. When $S_1$ goes high $T_1$ conducts and thus drives the rest of the circuit. The power consumption thus amounts to several hundredths of milliamperes.

An amplifier-converter processing circuit 15, 16 is provided which comprises two resistances $R_5$, $R_6$, two capacitances $C_2$, $C_4$, four potentiometers $P_1$, $P_2$, $P_3$, $P_4$, of an integrated circuit $CI_2$ (for example Analog Devices AD 2020), a Zener diode $Z_1$ and a voltage reference circuit $CI_3$ which can be of the LM 236 type. Elements $R_5$, $C_2$, and $Z_1$ achieve a voltage regulator and a filter for driving $CI_2$ so as to render its operation more precise and constant despite variations of voltage of the power source during its use. Resistance $R_6$ and circuit $CI_3$ define a reference voltage which is very stable for feeding transducer 8. Circuit $CI_2$ performs amplification and analog/numeric conversion of the signal furnished by transducer 8. Potentiometer $P_1$ allows for zero adjustment of the converter, while $P_2$ allows for adjustment of its gain. $C_4$ is the integration capacity of converter $CI_2$. Potentiometers $P_3$ and $P_4$ provide correspondence of the displayed value and a value measured by offsetting the feed of the transducer. Potentiometer $P_2$ adjusts the gain and potentiometere $P_1$ adjusts the zero of the amplifier.

The pilot and display module 9, 17 is constituted by two display cells $A_1$ and $A_2$ which receive numeric signals from circuit $CI_2$ and decode these signals so that the decoded value is then displayed.

FIGS. 11 and 12 represent an alternative embodiment with respect to the type of display. In effect according to the embodiment described previously, the display uses a numeric format but this need not necessarily be the case, without going beyond the scope of the invention. One can thus utilize a display of the incremented type having incremental points or segments. The segments are successive and discrete. Such a device 9' is, for example, available commercially under the denomination "BAR GRAPH" 9 the number of points or bars which illuminate is a function of the release force set.

FIG. 11 illustrates a binding adjusted to indicate 4. FIG. 12 illustrates in perspective an incremental display with its connection terminals positioned at its lower portion.

Figure 14:
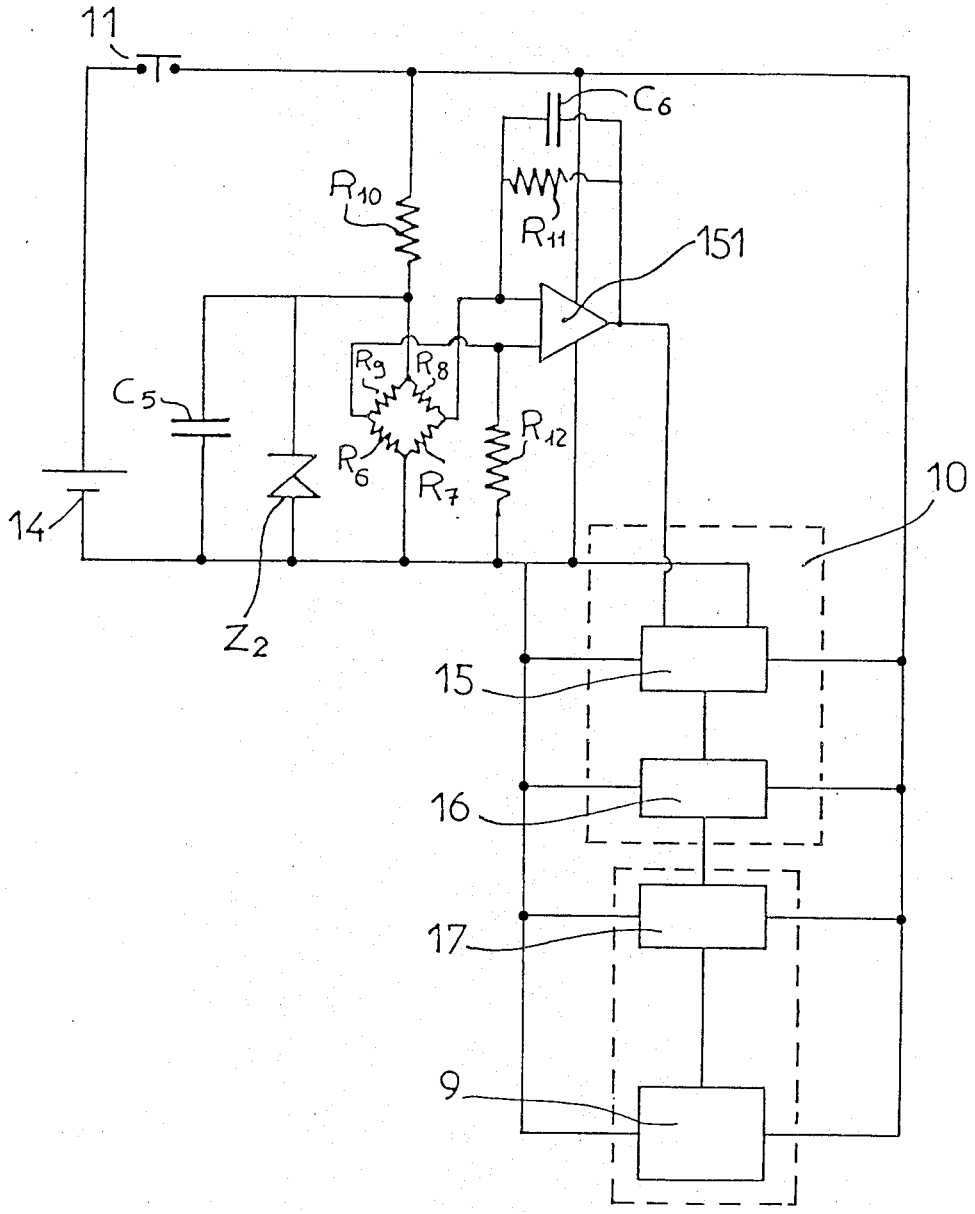
Figure 15:
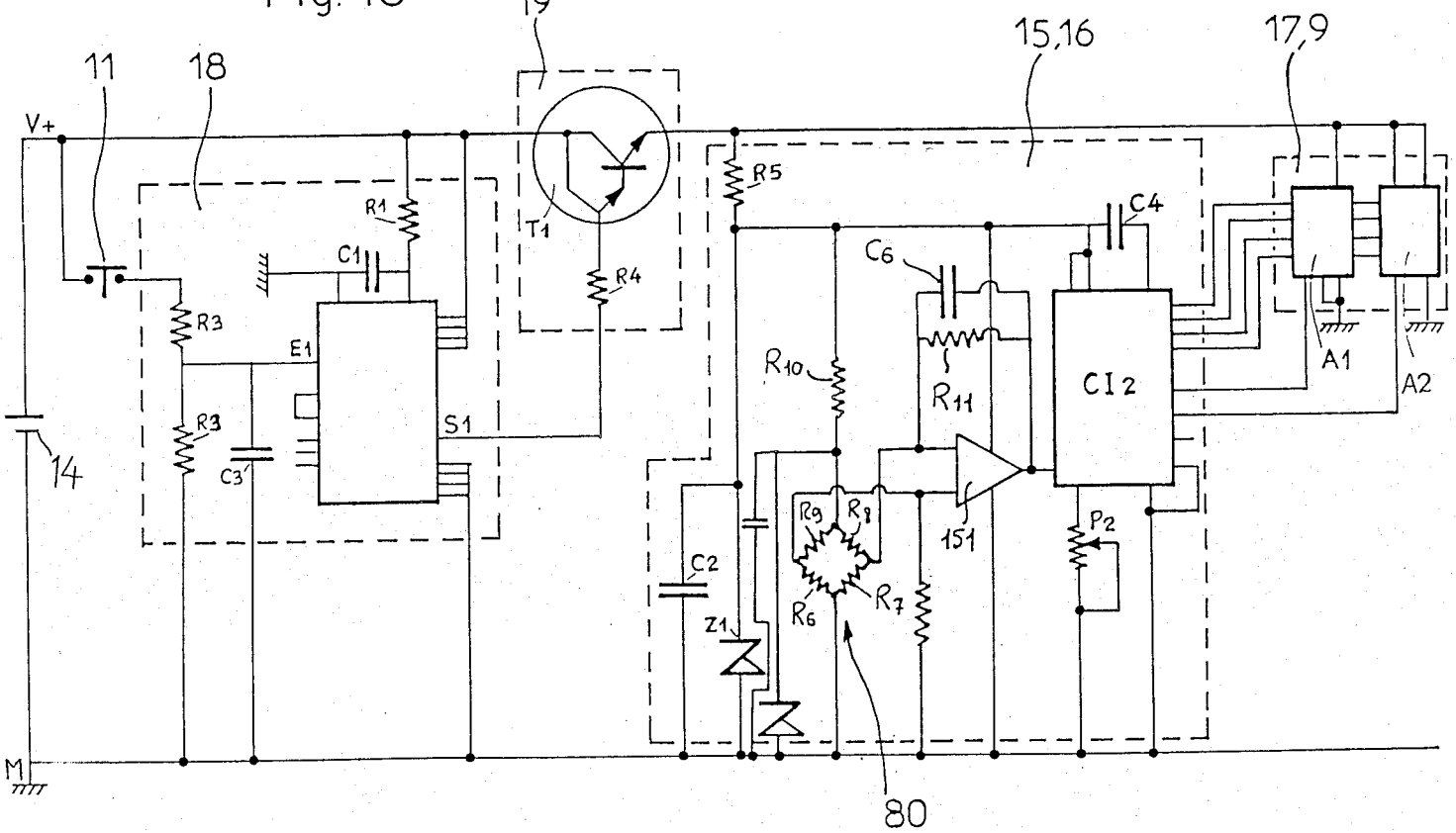

FIGS. 13–15 illustrate another embodiment according to which one measures the pressure exerted by spring 6 with strain gauge 80, instead of using a potentiometer as was previously discussed. The sensor is a force sensor which can be: a Hall effect type; a capacity effect type; a differential transformation type; or a wheatstone bridge system.

One embodiment is described below in which force sensing is performed by a wheatstone bridge 80 glued on a test body 81. The wheatstone bridge comprises four resistors $R_6$, $R_7$, $R_8$, and $R_9$, and a circuit 30 positioned to, on the one hand, stabilize the feed voltage of the wheatstone bridge and, on the other hand, to amplify its output signal.

As can be seen from FIG. 13, wheatstone bridge 80 is glued within a bowl-shaped test body 81 positioned within piston 5. The force of spring 6 is transmitted by an intermediate element 82 which comprises a central projection 83 pressed against the front face of test body 81. Under the action of spring 6, test body 81 deforms and the sensor registers the magnitude of the deformation and transmits a proportional signal to the data processing circuit 10 which, in turn, sends a signal to display module 9. The voltage to the terminals of the wheatstone bridge is stabilized by Zener diode $Z_2$, capacitance $C_5$ and resistance $R_{10}$. An amplifier is necessary since the output signal of the wheatstone bridge is too weak to directly drive the converter. This amplification is achieved by means of differential amplifier 151, and resistors $R_{11}$ and $R_{12}$. Preferably, a capacitance $C_6$ can be mounted in parallel with resistance $R_{11}$ to define the band pass of amplifier 151. Circuit 30 is thus constituted by resistances $R_{10}$, $R_{11}$, and $R_{12}$, by Zener diode $Z_2$, capacitances $C_5$ and $C_6$, and differential amplifier 151. Circuits 15, 16, 17 and 9, or 9' of the first embodiment can be utilized in the second embodiment as illustrated in FIGS. 14 and 15.

Although the invention has been described with reference to particular means, materials and embodiments, it is to be understood that the invention is not limited to the particulars disclosed and extends to all equivalent means, materials, circuits and the like included within the scope of the claims.

We claim:

1. A display apparatus for displaying the value of the release threshold to which a ski binding is adjusted, said binding comprising a retention element for retaining a ski boot on a ski, said retention element having a centered position and being adapted to pivot therefrom with respect to a support connected to said ski to free said boot, said retention element being returned to said centered position by an elastic mechanism which exerts a force whose value may be adjusted so as to define said release threshold value, said binding further comprising at least one movable element biased by a spring and an adjustment element for adjusting the tension of said spring and the force which it exerts on said movable element, said display apparatus further comprising an electronic circuit means, a potentiometer, and a display means, said potentiometer and said display means being electronically connected to said electronic circuit means, said potentiometer comprising means associated with said adjustment element of said binding for movement therewith, whereby said potentiometer is adapted to enable the generation of a signal indicative of the position of said adjustment element with respect to said binding thereby also being indicative of said release threshold value of said binding, said electronic circuit means being responsive to said signal enabled by said potentiometer for electronically transmitting said signal to said display means for displaying said release threshold value by means of said display apparatus.

2. A ski binding apparatus comprising a display apparatus for displaying the value of the release threshold to which said ski binding is adjusted, said binding comprising a retention element for retaining a ski boot on a ski, said retention element having a centered position and being adapted to pivot therefrom with respect to a support connected to said ski to free said boot, said retention element being returned to said centered position by an elastic mechanism which exerts a force whose value may be adjusted so as to define said release threshold value, said binding further comprising at least one movable element biased by a spring and an adjustment element for adjusting the tension of said spring and the force which it exerts on said movable element, said apparatus further comprising an electronic circuit means, potentiometer, and an electronic display means, said potentiometer and said display means being electronically connected to said electronic circuit means, said potentiometer comprising means associated with said adjustment element of said binding for movement therewith, whereby said potentiometer is adapted to enable the generation of a signal indicative of the position of said adjustment element with respect to said binding thereby also being indicative of said release threshold value of said binding, said electronic circuit means being responsive to said signal enabled by said potentiometer for electronically transmitting said signal to said display means for displaying said release threshold value of said binding by means of said display apparatus.

3. The apparatus as defined by either of claims 1 or 2, wherein said electronic circuit means comprises an electronic circuit for driving, controlling and processing said electronic information.

4. The apparatus as defined by claim 3 wherein said electronic display means comprises a module for electronically displaying said release threshold value.

5. The apparatus as defined by claim 4 wherein said module has a numeric display.

6. The apparatus as defined by claim 4 wherein said module has an incremented display.

7. The apparatus as defined by claim 4 wherein said potentiometer and said module are associated with the body of said binding, and wherein said electronic circuit is contained in a separate container which may remain physically separate from said binding and which is adapted to be electrically connected as required to said transducer and to said module.

8. The apparatus as defined by claim 7 wherein said module is positioned in said container.

9. The apparatus as defined by claim 7 wherein said module is mounted on said binding.

10. The apparatus as defined by claim 4 wherein said potentiometer, said module, and said electronic circuit are all physically mounted on the body of said binding, and are adapted to remain associated therewith during use.

11. The apparatus as defined by claim 3 wherein said potentiometer measures the displacement of said adjustment element relative to a reference point on said binding.

12. The apparatus as defined by claim 11 wherein said reference point is located on the body of said binding.

13. The apparatus as defined by claim 3 wherein said potentiometer comprises a wiper adapted to move along a winding, said wiper being operatively associated with said adjustment element whereby movement of said adjustment element moves said wiper along said winding.

14. The apparatus as defined by claim 13 wherein said winding is fixedly secured to the interior of said body.

15. The apparatus as defined by claim 14 wherein said adjustment element comprises an adjustment cap extending to the exterior of said body.

16. The apparatus as defined by claim 14 wherein said adjustment element is rotatable and is adapted to move in axial translation and comprises an annular groove adapted to receive said wiper therein whereby axial translation of said adjustment element moves said wiper along said winding.

17. The apparatus as defined by claim 16 wherein said winding comprises a strip mounted within said binding body, said wiper making electrical contact with said strip.

18. The apparatus as defined by claim 14 wherein said adjustment element is translationally fixed but is free to rotate.

19. The apparatus as defined by claim 18 wherein said spring is tensioned against a nut threadably mounted on said adjustment element whereby rotation of said adjustment element results in axial movement of said nut.

20. The apparatus as defined by claim 19 wherein said wiper is mounted to move with said nut along said winding.

21. The apparatus as defined by claim 14 wherein said wiper is a ring secured onto said adjustment screw, and wherein said wiper makes electrical contact with said winding during rotation and axial movement of said adjustment element.

22. The apparatus as defined by claim 21 wherein said ring is movable relative to said adjustment screw to allow for calibration of said apparatus.

23. The apparatus as defined by claim 3 wherein said electronic circuit comprises a battery, at least one switch, an amplifier, an analog-numeric converter, and a decoding and piloting circuit to drive said module.

24. The apparatus as defined by claim 23 wherein said electronic circuit further comprises a timer controlling a timing switch adapted to de-energize said circuit, whereby said display is de-energized after a pre-set time period.

25. The apparatus as defined by claim 24 further comprising a manual switch mounted in parallel across said timing switch to allow for override of said timing switch.

26. The apparatus as defined by claim 3 wherein said electronic circuit comprises an operational amplifier whose gain adjustment allows for the calibration of the display.

27. The apparatus as defined by claim 26 wherein calibration of said display is also possible by means of a zero adjustment.

28. A display apparatus for displaying the value of the release threshold to which a ski binding is adjusted, said binding comprising a retention element for retaining a ski boot on a ski, said retention element being set at a release threshold value to release said boot when said retention element is subjected to a force greater than said release threshold value, said display apparatus comprising an electronic circuit means, an electronic display means for electronically displaying said release threshold value of said binding, and a potentiometer, said electronic display means and said potentiometer being electronically connected to said electronic circuit means, said potentiometer comprising an element movable with a portion of said ski binding for enabling the generation of a signal indicative of said release threshold value at which said retention element is set thereby also being indicative of said release threshold value of said binding, said electronic circuit means being adapted to communicate said signal to said electronic display means to thereby display said release threshold value.

29. A ski binding apparatus comprising a display apparatus for displaying the value of the release threshold to which said ski binding is adjusted, said binding comprising a retention element for retaining a ski boot on a ski, said retention element being set to release said ski boot when said retention element is subjected to a force greater than said value of the release threshold, said display apparatus further comprising an electronic circuit means, a potentiometer, and a display means, said potentiometer and said display means being electronically connected to said electronic circuit means, said potentiometer comprising an element movable with a portion of said ski binding for enabling the generation of a signal indicative of said release threshold value at which said retention element is set thereby also being indicative of said release threshold value of said binding, said electronic circuit means being adapted to electronically transmit said signal enabled by said potentiometer to said display means for displaying said release threshold value of said binding.

30. The apparatus as defined by either of claims 28 or 29, wherein said electronic circuit means comprises an electronic circuit for driving, controlling and processing said electronic information.

31. The apparatus as defined by claim 30 wherein said electronic display means comprises a module for electronically displaying said release threshold value.

32. The apparatus as defined by claim 31 wherein said module has a numeric display.

33. The display apparatus as defined by claim 31 wherein said module has an incremented display.

34. The apparatus as defined by claim 31 wherein said transducer and said module are associated with the body of said binding, and wherein said electronic circuit is contained in a separate container which may remain physically separate from said binding and which is adapted to be electrically connected as required to said transducer and to said module.

35. The apparatus as defined by claim 34 wherein said module is located in said container.

36. The apparatus as defined by claim 34 wherein said module is positioned on said binding.

37. The apparatus as defined by claim 33 wherein said potentiometer, said module, and said electronic circuit are all associated with the body of said binding, and are adapted to remain associated therewith during use.

38. The apparatus as defined by claim 33 wherein said electronic circuit comprises a battery, at least one switch, an amplifier, an analog-numeric converter, and a decoding and piloting circuit to drive said module.

39. The apparatus as defined by claim 38 wherein said electronic circuit further comprises a timer controlling a timing switch adapted to de-energize said circuit, whereby said display is de-energized after a pre-set time period.

40. The apparatus as defined by claim 39 further comprising a manual switch mounted in parallel across said timing switch to allow for override of said timing switch.

* * * * *

UNITED STATES PATENT AND TRADEMARK OFFICE

CERTIFICATE OF CORRECTION

PATENT NO. : 4,776,608

DATED : October 11, 1988

INVENTOR(S) : Claude CAILLAT et al.

It is certified that error appears in the above-identified patent and that said Letters Patent is hereby corrected as shown below:

At column 3, line 12, change "crew" to ---screw---.

At column 3, lines 24-25, change "analog-numeric numeric converter" to ---analog-numeric converter---.

At column 6, line 59, change "assemly" to ---assemoly---.

At column 8, line 25, change "potentiometere" to ---potentiometer---.

At column 10, line 31, change "transducer" to --potentiometer--.

At column 12, line 33, change "transducer" to --potentiometer--.

At column 12, line 38, change "transducer" to --potentiometer--.

Signed and Sealed this

Twenty-third Day of April, 1991

*Attest:*

*Attesting Officer*

HARRY F. MANBECK, JR.

*Commissioner of Patents and Trademarks*